US009399869B2

(12) United States Patent
Sorkin

(10) Patent No.: US 9,399,869 B2
(45) Date of Patent: Jul. 26, 2016

(54) APPARATUS AND METHOD FOR CONNECTING A SEGMENTAL COUPLER TO A STEEL PLATE OR ANCHOR CASTING

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 14/735,570

(22) Filed: Jun. 10, 2015

(65) Prior Publication Data

US 2016/0010334 A1 Jan. 14, 2016

Related U.S. Application Data

(60) Provisional application No. 62/023,293, filed on Jul. 11, 2014.

(51) Int. Cl.

| | |
|---|---|
| ***E04C 5/08*** | (2006.01) |
| ***E04C 5/12*** | (2006.01) |
| ***E04C 5/10*** | (2006.01) |
| ***E04C 5/16*** | (2006.01) |

(52) U.S. Cl.
CPC ... *E04C 5/12* (2013.01); *E04C 5/10* (2013.01); *E04C 5/16* (2013.01)

(58) Field of Classification Search
CPC ..... E04C 5/10; E04C 5/12; E04C 5/16; E04C 5/122
See application file for complete search history.

(56) References Cited

U.S. PATENT DOCUMENTS

| | | | | |
|---|---|---|---|---|
| 5,474,335 | A | 12/1995 | Sorkin | |
| 5,775,849 | A | 7/1998 | Sorkin | |
| 5,954,373 | A | 9/1999 | Sorkin | |
| 6,390,007 | B1 * | 5/2002 | Walker | B63B 13/02 111/183 R |
| 6,419,104 | B1 * | 7/2002 | Sarajian | B05B 15/0462 215/358 |
| 6,752,435 | B1 | 6/2004 | Sorkin | |
| 6,764,105 | B1 | 7/2004 | Sorkin | |
| 6,834,890 | B2 | 12/2004 | Sorkin | |
| 6,874,821 | B1 | 4/2005 | Sorkin | |
| 7,267,375 | B1 | 9/2007 | Sorkin | |
| 7,273,238 | B1 | 9/2007 | Sorkin | |
| 7,686,347 | B1 | 3/2010 | Sorkin | |
| 7,695,021 | B1 | 4/2010 | Sorkin | |
| 8,398,123 | B1 | 3/2013 | Sorkin | |

* cited by examiner

*Primary Examiner* — Patrick Maestri
(74) *Attorney, Agent, or Firm* — Egbert Law Offices, PLLC

(57) ABSTRACT

An duct coupler apparatus for sealing a bore of an anchor includes a coupler having an inner wall and a sealing mechanism affixed to the inner wall of the coupler. The sealing mechanism includes a shaft and sealing element affixed adjacent an end of the shaft. The sealing element is selectively movable between a retracted condition and an extended condition. The extended condition is adapted to be in sealing relation with an inner wall of the bore of the steel structure. The apparatus includes a nut threadedly affixed to the shaft so as to bear against the sealing element. The nut is rotatable on the shaft so as to urge against the sealing element so as to cause the sealing element to be in the extended or expanded condition.

17 Claims, 2 Drawing Sheets

APPARATUS AND METHOD FOR CONNECTING A SEGMENTAL COUPLER TO A STEEL PLATE OR ANCHOR CASTING

CROSS-REFERENCE TO RELATED APPLICATIONS

The present application claims priority from U.S. Provisional Patent Application Ser. No. 62/023,293, filed on Jul. 11, 2014, and entitled "Apparatus for Connecting a Segmental Coupler to a Steel Plate or Anchor Casting".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the assembly and installation of precast concrete segments used in construction activities, such as bridge and highway construction. More particularly, the present invention relates to couplers for use in joining the end of a duct of such precast concrete segments to a steel plate, to a bar or to an anchor casting.

2. Description of Related Art Including Information Disclosed Under 37 CFR 1.97 and 37 CFR 1.98.

Precast segmental bridges are known and commonly used throughout the world as a means to forge roadways through mountainous terrain or cross rivers or other barriers. Such bridges are typically constructed in accordance with the following sequence. First, series of upright piers are formed along the bridge span. Thereafter, cantilevered bridge sections are built out of each pier by successively mounting the precast segments to previously completed bridge components and post-tensioning the segments together. The cantilevered bridge segments are build out from each pier in a symmetrical fashion so that the piers are not subjected to undue bending loads. When the cantilevered sections are complete, the ends thereof are post-tensioned together to form a continuous bridge deck. Typically, two such bridge spans are constructed to accommodate the two directions of travel.

During the formation of the concrete segments, it is often necessary to apply steel bars, anchors, bulkheads, or plates thereto. As such, such steel structures are embedded in the concrete during the formation of the particular concrete segment. As such, a need has developed whereby a duct system (including the duct coupler) is joined to the steel structure prior to the pouring of the concrete for the particular concrete segment. It is important, under such circumstances, that the coupler be formed at the side surface of the concrete segment. In this manner, it is important to be able to releasably retain the coupler of the particular duct against the steel structure during the formation of the concrete segment.

During the formation of such concrete segments, it is important to be able to establish proper seals such that water, or other liquid, associated with the pouring of the concrete does not infiltrate the duct or into the interior bore of the steel structure. If any such leakage should occur, then such leakage could corrode the surfaces of the steel structure or could interfere with the ability to properly post-tension the cables extending through the ducts thereof. It is also it is also important to maintain the duct, along with the duct coupler in a proper position during the pouring of the concrete for the concrete segment.

The ability to avoid air and liquid intrusion into the interior of the duct it is very important in such multi-strand, precast concrete segmental structures. Since the structure is often used on bridges or elevated structures, the post-tensioning cables can be subject to a great deal of exposure from the elements. For example, if the bridge structures are associated with roads traveled by motor vehicles, then there is often the application of salt onto the highway. The salt, when dissolved in water, can leach through the area between this structure segments and into the duct so as to deteriorate the post-tensioning cables over time. As the post-tensioning cables become corroded, they can weaken so as to potentially cause the failure of the segmental structure. Past experience with such structures has shown that the primary area of leakage would be in those cracks formed between those matched concrete segments. As such, it is particularly important to provide a coupler for use in association with the polymeric ducts which will effectively prevent any liquid intrusion from entering the interior of the ducts and adjacent to the post-tensioning cables.

In the past, various patents have issued to the present inventor relating to such duct couplers and segmental construction systems. For example, U.S. Pat. No. 5,474,335, issued on Dec. 12, 1995 to the present inventor, describes a duct coupler with hinged interconnected locking rings. The coupler includes a body, flexible cantilevered sections on the end of the body adapted to pass over annular protrusions on the duct, and locking rings for locking the cantilevered flexible sections into position. As such, the coupler can be locked onto the duct.

U.S. Pat. No. 5,775,849, issued on Jul. 7, 1998 to the present inventor, teaches a duct system for post-tension rock anchorage systems that includes a first duct having a plurality of corrugations extending radially outwardly therefrom, a second duct having a plurality of corrugations extending radially outwardly therefrom, and a tubular body threadedly receiving the first duct at one end and threadedly receiving the second duct at the opposite end. The tubular body has a first threaded section formed on an inner wall of the tubular body adjacent one end of the tubular body and a second threaded section formed on the inner wall of the tubular body adjacent an opposite end of the tubular body. The threaded sections are formed of a harder polymeric material than the polymeric material of the first and second ducts.

U.S. Pat. No. 5,954,373, issued on Sep. 21, 1999 to the present inventor, describes a duct coupler apparatus for use on multi-strand post-tensioning systems. The coupler includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending around an exterior of the tubular body. The compression device includes an arm with an end hingedly connected to the tubular body and having an abutment surface adjacent the end. The arm is movable between a first position extending outwardly of an exterior of the tubular body and a second position aligned with an exterior of the tubular body.

U.S. Pat. No. 6,752,435, issued on Jun. 22, 2004 to the present inventor, describes an asymmetrical coupler apparatus for use with precast concrete segmental construction. This coupler system includes a first duct, a first coupler member extending over and around an exterior surface of the first duct and having an end opening adjacent an end of the first duct, a second duct, a second coupler member extending over and around in exterior surface of the second duct and an end opening adjacent to an end of the second duct, and a gasket received in the ends of the first and second coupler members. The gasket serves to prevent liquid from passing between the ends of the coupler members into an interior of either of the first and second ducts. An external seal is affixed to an opposite end of the first coupler member and affixed to an exterior surface of the first duct. An internal seal is interposed in generally liquid-tight relationship between an interior surface of the second coupler member and an exterior surface of the second duct.

U.S. Pat. No. 6,764,105, issued on Jul. 20, 2004 to the present inventor, describes a duct coupler apparatus for use with precast segmental concrete construction. This coupler member includes a first duct, a first coupler member extending over and around an exterior surface of the first duct and having a seat opening adjacent an end of the first duct, a second duct, a second coupler member extending over and around an exterior surface of the second duct and a seat opening adjacent an end of the second duct, and a gasket received in the seats of the first and second coupler members. An external seal is affixed to an opposite end of the first coupler member and affixed to an exterior surface of the first duct. The seats of the first and second coupler members have slot facing one another. The gasket is received within the slots.

U.S. Pat. No. 6,834,890, issued on Dec. 28, 2004 to the present inventor, shows a coupler apparatus for use with a tendon-receiving duct in a segmental precast concrete structure. This coupler apparatus includes a coupler body having an interior passageway for receiving the duct therein. The coupler body has a generally U-shaped channel formed at one end thereof. The coupler element has a connector element formed on an interior thereof adjacent one end the coupler body so as to allow the coupler element to receive a variety of implements for the formation of the precast concrete segment.

U.S. Pat. No. 6,874,821, issued on Apr. 5, 2005 to the present inventor, shows a coupler apparatus for use with precast concrete segmental construction. This coupler apparatus has a first duct, a first coupler member extending over and around the first duct, a second duct, a second coupler member extending over and around the second duct, and a gasket received at the ends of the first and second coupler members so as to prevent liquid from passing between the coupler members into an interior of either of the ducts. The ducts extend at a non-transverse acute angle with respect to the ends of the coupler members. Heat shrink seals are affixed to the opposite ends of the coupler member so as to secure the coupler members to the ducts in liquid-tight relationship. The ends of the coupler members have generally V-shaped grooves facing each other.

U.S. Pat. No. 7,267,375, issued on Sep. 11, 2007 to the present inventor, provides a duct coupler apparatus for joining the ends of a pair of ducts together in end-to-end relationship. This apparatus has a collar with a first end portion and a second end portion. A first coupler element is translatably secured to an exterior of the collar for moving the first end portion between the first and second positions. A second coupler element is translatably secured to the exterior of the collar so as to move the second end portion between first and second positions. The end portions have a plurality of fingers that are movable so as to be free of the surface of the duct when in the first position and which contact a rib of the duct when in the second position.

U.S. Pat. No. 7,273,238, issued on Sep. 25, 2007 to the present inventor, describes a duct coupler apparatus for joining the ends of a pair of ribbed ducts together. This duct coupler apparatus has a collar with an interior suitable for receiving the ends of the pair of ducts therein. A first coupler element is translatably secured adjacent a first end of the collar. A compressible seal is disposed between a surface of the first coupler element and the first end of the collar. A second coupler element is secured adjacent a second end of the collar. A second seal is disposed between a surface of the second coupler element and the second end of the collar. The coupler elements are translatable so as to compress the seal such that a surface of the seal will bear against a respective rib of the pair of ducts.

U.S. Pat. No. 7,686,347, issued on Mar. 30, 2010 to the present inventor, shows a coupler apparatus for use with concrete segments. This coupler apparatus has a first duct, a first coupler member having a connector, and a flexible boot extending therefrom and having an end extending over a surface of the first duct. A second duct and a second coupler member are provided. The second coupler member has a connector and a flexible boot extending therefrom and extending over an exterior surface of the second duct. A gasket is received in the connectors of the first and second coupler members for forming a liquid-tight seal between the first and second ducts. Clamps are affixed over the ends of the flexible boots so as to establish a liquid-tight seal with the respective duct.

U.S. Pat. No. 7,695,021, issued on Apr. 13, 2010 to the present inventor, teaches a coupler apparatus for use with concrete segments that has a first duct, a first coupler member connected to the first duct, a second duct, a second coupler member connected to the second duct, and a gasket member received in a channel of the connector of the first coupler member and extending outwardly therefrom. The gasket member is in compressible contact with an abutment surface of the second coupler member. The gasket member has a generally U-shaped cross-section with a curved end extending outwardly of an opening of the channel of the first coupler member. The abutment surface is a planar flanged surface extending radially transversely outwardly of the end of the second coupler member.

U.S. Pat. No. 8,398,123, issued on Mar. 19, 2013 to the present inventor, shows a duct coupling system that has a first duct with an end having threads thereon and a second duct having an end with threads thereon. A coupler is provided having a first end threadedly engaged with the threads of the first duct and a second end threadedly engaged with threads of the second duct. The ducts and the coupler each integrally formed of a polymeric material.

It is an object of the present invention to provide a duct coupler apparatus which allows for the coupling of multi-tendon ducts in precast segmental concrete structures.

It is another object of the present invention to provide a duct coupler system which allows the segmental coupler to be connected to a steel plate or anchor casting.

It is another object of the present invention to provide an apparatus and method for connecting a segmental coupler removably to a steel structure, such as an anchor, a bearing plate, a bar, or a bulkhead.

It is still a further object of the present invention to provide a duct coupler apparatus which effectively seals the interior of the steel structure during the pouring of the concrete segment and also seals the interior of the duct.

It is still a further object of the present invention to provide a method and apparatus for connecting a segmental coupler to a steel structure which is easy to install, easy to use and easy to manufacture.

These and other objects and advantages of the present invention will become apparent from a reading of the attached specification and appended claims.

BRIEF SUMMARY OF THE INVENTION

The present invention is an apparatus that comprises a steel structure having a bore formed therein and a facing surface, a duct, a duct coupler joined to the duct and having an end positioned against the facing surface of the steel structure, and a sealing mechanism affixed to the inner wall of the duct coupler. The sealing mechanism includes a shaft extending in a direction toward the facing surface of the steel structure, and a sealing element affixed to the shaft. The sealing element is positioned within the bore of the steel structure. The sealing element is selectively movable between a retracted condition and an extended condition. The extended condition is in sealing relation with a wall of the bore.

In the apparatus of the present invention, the shaft is threaded. A nut is threadedly affixed to the shaft so as to bear against the sealing element. The nut is rotatable on the shaft so as to urge against the sealing element so as to cause the sealing element to be in the extended condition. The nut has wings extending radially outwardly therefrom. The sealing element is an annular elastomer element. In particular, this annular elastomer element has a diameter greater at one end than a diameter of a remainder of the elastomer element.

A ring is threadedly affixed to an inner wall of the duct coupler. The duct coupler has an annular channel at an end thereof. The annular channel has a seal therein. The duct coupler is positioned against the facing surface of the steel structure such that the seal is in liquid-tight sealing relation with the facing surface of the steel structure.

In an alternative embodiment, the sealing mechanism includes a ring element affixed within an interior of the ring, and a latch cooperative at the shaft and supported by the ring element. The latch is movable between a first position in which the sealing element is in the retracted condition and a second position in which the sealing element is in the extended condition. The ring has a receptacle formed in an inner wall thereof. The ring element is affixed within the receptacle. In particular, the receptacle of the ring is a thread. The ring element is threadedly engaged with the thread.

The steel structure is selected from the group consisting of an anchor, a bearing plate, a bar and a bulkhead. In particular, when the steel structure has an anchor, the anchor has a channel opening at one end of the facing surface and opposite and opening to the bore. The opposite end of the channel opens to the bore of the anchor in a location beyond the sealing element.

The present invention is also an apparatus for sealing an interior of a bore of a steel structure. This apparatus includes a coupler having an inner wall, and a sealing mechanism affixed to the inner wall of the coupler. The sealing mechanism includes a shaft, and a sealing element affixed adjacent an end of the shaft. The sealing element is selectively movable between a retracted condition and an extended condition. The extended condition is adapted to be in sealing relation with an inner wall of the bore of the steel structure.

In this embodiment of the invention, the shaft is threaded. A nut is threadedly affixed to the shaft so as to bear against the sealing element. The nut is rotatable on the shaft so as to urge against the sealing element so as to cause the sealing element to be in the extended condition. The sealing element is an annular elastomer element in which an outer diameter of the elastomer element expands upon application of a force to an end surface of the elastomer element.

A ring is threadedly affixed to the inner wall of the duct coupler. The duct coupler has an annular channel at the end thereof adjacent to the facing surface of the steel structure. The annular channel has a seal therein. The coupler is positioned against the facing surface of the steel structure such that the seal is in liquid-tight sealing relationship with the facing surface of the steel structure.

This foregoing Section is intended to describe, with particularity, the preferred embodiments of the present invention. It is understood that modifications to these preferred embodiments can be made within the scope of the present claims without departing from the true spirit of the invention. As such, the Section should not be construed, in any way, as limiting of the broad scope of the present invention. The present invention should only be limited by the following claims and their legal equivalents.

DETAILED DESCRIPTION OF THE INVENTION

Figure 1:
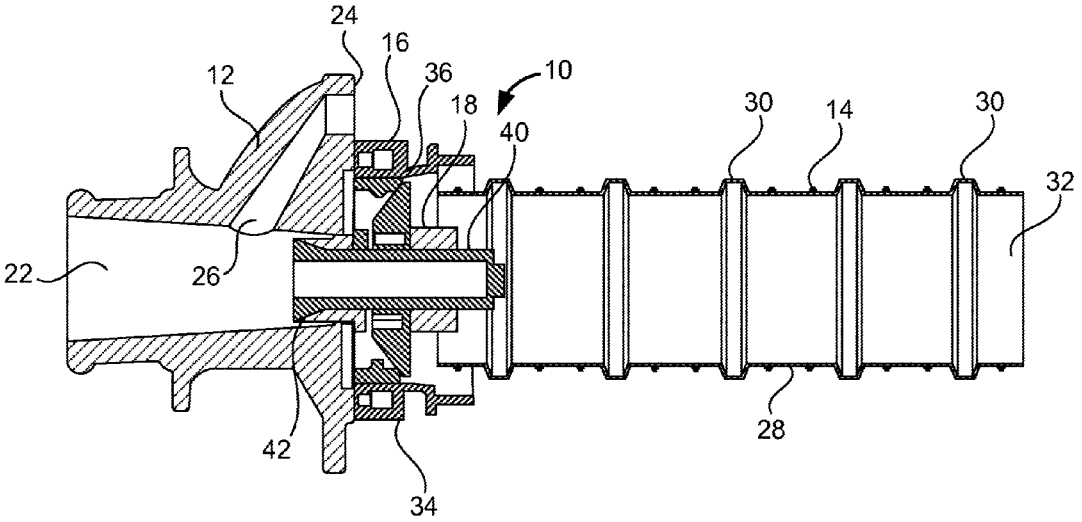
FIG. 1 is a cross-sectional side view showing the duct coupler apparatus of the present invention.

Referring to FIG. 1, there is shown the connector assembly 10 in accordance with the teachings of the present invention. The connector assembly 10 includes a steel structure 12, a duct 14, a duct coupler 16, and a sealing mechanism 18. In particular, the steel structure 12 can be in the nature of an anchor, a bearing plate, a bar or a bulkhead. In particular, in the preferred embodiment of the present invention, the steel structure 12 is in the form of an anchor. The anchor 20 has a bore 22 formed on the interior thereof. The anchor 20 has a facing surface formed at one end thereof. A channel 26 is formed through the anchor so as to have one end opening at the facing surface 24 and an opposite end opening to the bore 22. This channel 26 extends through the body of the anchor. The opposite end of the channel 26, as will be described hereinafter, opens to the interior of the bore in a location beyond the sealing element. As such, when the sealing element seals the interior of the bore, liquid materials can be delivered through the channel 26 into the remaining interior of the bore 22 or can be removed from the bore 22 through the channel 26.

The duct 14 is in the nature of the duct described hereinbefore in association with the previous patents to the present inventor. The duct 14 includes a longitudinal tubular body 28 that has a plurality of ribs 30 formed on the exterior thereof. Ribs 30 will open to the interior passageway 32 of the duct 14. The ribs 30 can be utilized so as to enhance the gripping forces between the duct 14 and the concrete into which the duct 14 is installed. A plurality of tendons or cables can extend through the interior passageway 32 during the installation of the concrete segments.

In FIG. 1, it can be seen that the duct coupler 16 includes a sealing section 34 formed at the end thereof adjacent to the facing surface 24 of the anchor 20. The sealing section 34 includes an annular channel that opens to the facing surface 24 of the anchor 20. An O-ring seal is received within this annular channel so as to bear against the facing surface 24 in order to establish a sealing relationship therewith. An internal ring 36 is positioned on the interior of the coupler 16. The internal ring can be threadedly affixed adjacent the end of the coupler 16 that bears against the facing surface 24. Alternatively, the internal ring can be in snap-fit engagement with suitable elements that are arranged on the interior of the coupler 16. This arrangement allows the internal ring 36 to be removably installed into the coupler 16. The sealing mechanism 18 is engaged with the internal ring 36 such that the internal ring 36 releasably supports the sealing mechanism 18 in a proper proximity to the anchor 20.

In FIG. 1, it can be seen that the sealing mechanism 18 includes a shaft that extends into the bore 22 of the anchor 20. A plug 42 is supported by the shaft 40. This plug 42 is in the nature of a sealing element formed of an elastomeric material. The plug 42 is secured within the bore 22 of the anchor 20 in liquid-tight sealing relationship. In this configuration, liquid intrusion into the bore 22 is prevented. Similarly, the O-ring seal within the annular channel of the sealing section 34 of the coupler 16 prevents liquid intrusion into the interior passageway of the duct 14. As will be described hereinafter, the plug 42 is an sealing element that can be selectively changed from a retracted condition to an extended condition. When the plug 42 is inserted into the bore 22 of the anchor 20, the plug 42 can be extended or expanded so that the outer walls of the plug 42 tightly engage with the inner wall of the bore 22. To facilitate removal, the plug 42 can be moved to its retracted condition so as to be either easily inserted into the bore 22 or removed therefrom.

In normal use, the anchor 12 will be positioned adjacent a side of a concrete segment. The duct 14, with the coupler 16 attached thereto, can be placed against the facing surface 24. The sealing mechanism 18 is actuated such that the plug 42 will reside within the bore 22. The sealing mechanism can further be actuated so that the plug 42 extends so as to reside in liquid-tight relationship against the inner wall of the bore 22. As such, the plug 42 serves to fix the position of the coupler 16 and the duct 14 with respect to the anchor 12 while, at the same time, preventing liquid intrusion in the manner described hereinbefore. Once installed in this manner, concrete can be poured over and around the duct 14 and the coupler 16 and can also be poured over and around the anchor 12. After the concrete has set, the plug can be moved to its retracted condition so as to be released from the bore 22 such that the coupler 16 remains in a proper position for joining with the duct of another concrete segment. The internal ring 36 can be unscrewed from the interior of the coupler 16. As such, the sealing mechanism 18 can also be removed. The duct 14, along with the coupler 16, is now in a proper position for use.

Figure 2:
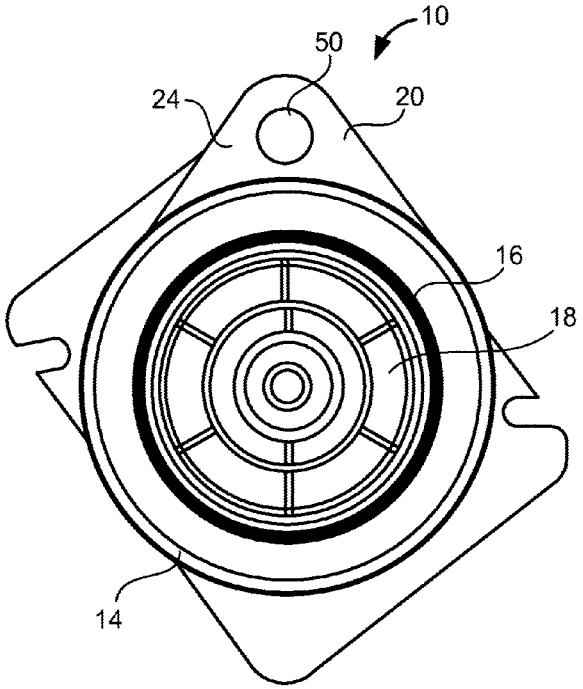
FIG. 2 is an end view of the duct coupler apparatus of the present invention.

FIG. 2 shows an end view of the coupler apparatus 10 of the present invention. In particular, the anchor 20 is illustrated as having an opening 50 at the facing surface thereof. This opening 50 will reside in a location beyond the arrangement of the duct coupler and sealing mechanism. As such, this allows an independent technique for allowing the introduction or removal of liquids from the bore 22. In particular, the anchor 20 is illustrated as having facing surface 24 thereon. Facing surface 24 will be of a smooth planar configuration. The bore 22 opens at the facing surface 24 and will extend through the interior of the anchor 20.

The coupler 16 is illustrated so as to be of an annular configuration. The end 52 of the coupler 16 will have the sealing section 34 formed therein. As such, the O-ring seal is in a proper position for bearing against the facing surface 24 of the anchor 20. The internal ring 36 is also illustrated as of an annular configuration. The outer surface of the internal ring has an external threads 54 formed thereon. These external threads 54 can removably engage with the internal threads formed on the interior of the coupler 16. As such, the internal ring 36 can be threadedly and removably secured within the interior of the coupler 16. The internal ring 36 also has a receptacle 56 formed therein. Receptacle 56 is, in the preferred embodiment, at least one thread. Once installed, the internal ring 36 will reside adjacent to the facing surface 24 of the anchor 20.

Figure 3:
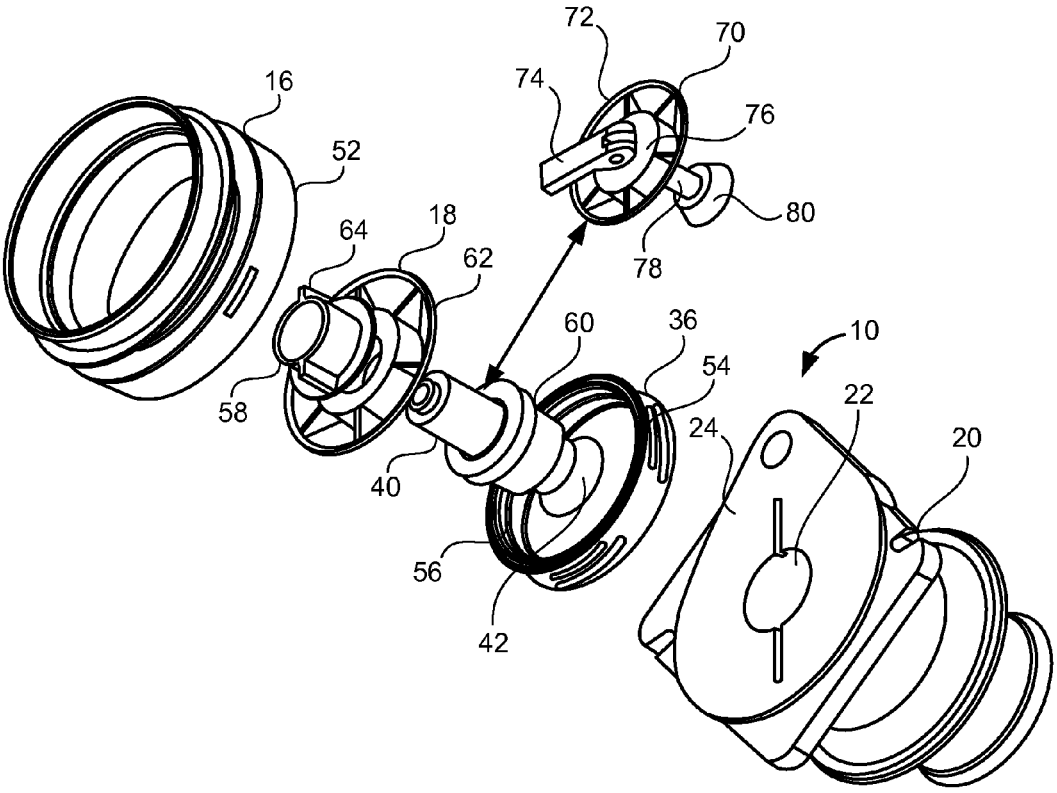
FIG. 3 is an exploded view of the duct coupler apparatus of the present invention.

The sealing mechanism 18 is illustrated in FIG. 3 as having the shaft 40 extending therefrom. A nut 58 is threadedly positioned on the shaft. A sealing element 60 is positioned adjacent to the end of the shaft 40. The sealing mechanism 18 further includes a ring element 62 that is configured so as to be either threadedly received or in snap-fit relationship with the receptacle 56 of the internal ring 36. The nut 58 includes wings 64 that extends radially outwardly therefrom. In normal use, the nut 58 can be rotated, through the use of the wings 56, so as to compress the sealing element 60 so as to urge the expandable element into the extended condition within the bore 22 of the anchor 20. The sealing element 60 can be in the nature of a plurality of soft rubber rings. As such, when a suitable force is applied to one end of the plurality of soft rubber rings, the rings will expand outwardly so as to increase in outer diameter in order to engage with the inner wall of the bore 22. Alternatively, or in conjunction therewith, a stopper 42 can be located on the shaft 40. The nut 58 can be suitably rotated so as to urge the stopper 42 into the bore 22 of the anchor 20. In either configuration, a proper liquid-tight seal is established between the sealing element 60 and the inner wall of the bore 22. When the stopper 42 is used, it can be seen that the stopper 42 is an annular elastomer element that has a tapered outer diameter with a widest diameter located at an end opposite to the shaft 78.

FIG. 3 further shows an alternative embodiment of the sealing mechanism 70. Sealing mechanism 70 includes ring element 72 that is configured so as to get engage in either threaded or snap-fit relationship with the receptacle 56 of the internal ring 36. A latch is provided on a surface of the latch mechanism 70. The shaft 78 extends outwardly from the latch 74. A sealing element 80 is affixed to the shaft 78. The latch 70 is affixed to the shaft 78. The latch 74 has a cam element such that when the latch 74 is in one position, the sealing element 80 will be in a retracted condition so as to be free of the inner wall of the bore 22 of the anchor 20. In another position of the latch 74, the sealing element 80 will moved to an extended condition so as to be in liquid-tight relationship with the bore 22 of the anchor 20. The sealing mechanism 70 is in the nature of a plug of a thermos bottle. For the purposes of the insertion of the sealing element 80 into the bore, the sealing element 80 will be in a retracted condition. When it is desired to seal the bore 22 of the anchor 20, the latch is moved to the other position so as to cause the sealing element 80 to increase in outer diameter and engage the wall of the bore in liquid-tight relationship.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. An apparatus comprising:

a steel structure having a bore formed therein, said steel structure having a facing surface;

a duct;

a duct coupler, said duct coupler having an end positioned against said facing surface of said steel structure, said duct coupler having an inner wall extending around said duct; and a sealing mechanism affixed to said inner wall of said duct coupler, said sealing mechanism comprising:

a shaft extending in a direction toward said facing surface of said steel structure; and an sealing element affixed to said shaft, said sealing element positioned within said bore of said steel structure, said sealing element selectively movable between a retracted condition and an extended condition, said extended condition for being in sealing relationship with a wall of said bore.

2. The apparatus of claim 1, said shaft being threaded, the apparatus further comprising:

a nut threadedly affixed to said shaft so as to bear against said sealing element, said nut being rotatable on said shaft so as to urge against said sealing element so as to cause said sealing element to be in said sealing condition.

3. The apparatus of claim 2, said nut having wings extending radially outwardly therefrom.

4. The apparatus of claim 1, said sealing element being an annular elastomer element.

5. The apparatus of claim 4, said annular elastomer element having an end having a diameter greater than a diameter of a remainder of said annular elastomer element.

6. The apparatus claim 1, said sealing mechanism further comprising:

a ring threadedly affixed to said inner wall of said duct coupler.

7. The apparatus of claim 1, said duct coupler having an annular channel at said end thereof, said annular channel having a seal therein, said duct coupler positioned against said facing surface of said steel structure such that said seal is in liquid-tight sealing relation with said facing surface of said steel structure.

8. The apparatus of claim 6, said sealing mechanism further comprising:

a ring element affixed within an interior of said ring; and a latch cooperative with said shaft and supported by said ring element, said latch movable between a first position in which said sealing element is in the retracted condition and a second position in which said sealing element is in the extended condition.

9. The apparatus of claim 8, said ring having a receptacle formed on an inner wall thereof, said ring element being affixed within said receptacle.

10. The apparatus of claim 8, said receptacle of said ring being a thread, said ring element being threadedly engaged with said thread.

11. The apparatus of claim 1, said steel structure selected from the group consisting of an anchor, a bearing plate, a bar and a bulkhead.

12. The apparatus of claim 1, said steel structure being an anchor, said anchor having a channel opening at one end to said facing surface and an opposite and opening to said bore.

13. An apparatus for sealing an interior of a bore of a steel structure, the apparatus comprising:

a coupler having an inner wall; and a sealing mechanism affixed to said inner wall of said coupler, said sealing mechanism comprising:

a shaft, a sealing element affixed adjacent an end of said shaft, said sealing element selectively movable between a retracted condition and an extended condition, said sealing element adapted to be in sealing relation with an inner wall of the bore of the steel structure when in the extended condition; and a ring threadedly affixed to said inner wall of said coupler.

14. The apparatus of claim 13, said sealing element being an annular elastomer element in which an outer diameter of said annular elastomer element expands upon application of a force to an end surface of said annular elastomer element.

15. An apparatus for sealing an interior of a bore of a steel structure, the apparatus comprising:

a coupler having an inner wall; and a sealing mechanism affixed to said inner wall of said coupler, said sealing mechanism comprising:

a shaft; and a sealing element affixed adjacent an end of said shaft, said sealing element selectively movable between a retracted condition and an extended condition, said sealing element adapted to be in sealing relation with an inner wall of the bore of the steel structure when in the extended condition, said coupler having an annular channel at an end thereof, said annular channel having a seal therein, said coupler adapted to be positioned against a facing surface of the steel structure such that the seal is in liquid-tight sealing relationship with the facing surface of the steel structure.

16. The apparatus of claim 15, said sealing mechanism further comprising:

a ring element affixed within an interior of said ring; and a latch cooperative with said shaft and supported by the ring said ring element, said latch movable between a first position in which said sealing element is in said retracted condition and a second position in which said sealing element is in said sealing condition.

17. The apparatus of claim 16, said ring having a receptacle formed on an inner wall thereof, said ring element being affixed within said receptacle.

* * * * *